US007832823B2

(12) United States Patent
Yun

(10) Patent No.: US 7,832,823 B2
(45) Date of Patent: Nov. 16, 2010

(54) IMAGE FORMING APPARATUS AND CONTROL METHOD THEREOF

(75) Inventor: Young-jung Yun, Suwon-si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 325 days.

(21) Appl. No.: 12/014,936

(22) Filed: Jan. 16, 2008

(65) Prior Publication Data

US 2008/0291231 A1 Nov. 27, 2008

(30) Foreign Application Priority Data

May 21, 2007 (KR) ..... 10-2007-0049235

(51) Int. Cl.
*B41J 29/38* (2006.01)

(52) U.S. Cl. ..... 347/14; 347/19

(58) Field of Classification Search ..... 347/14, 347/16, 17, 19, 37
See application file for complete search history.

(56) References Cited

U.S. PATENT DOCUMENTS 6,457,797 B1 * 10/2002 Van Der Meijs et al. ..... 347/14
6,827,418 B2 * 12/2004 Otokita ..... 347/19
7,232,198 B2 * 6/2007 Ogino et al. ..... 347/19

* cited by examiner

*Primary Examiner*—Thinh H Nguyen
(74) *Attorney, Agent, or Firm*—Stanzione & Kim LLP

(57) ABSTRACT

An image forming apparatus, includes an image forming unit, a driver having a driving unit as a driving source of the image forming unit, a detector which detects driving information of the driving unit, and a controller which controls the driver to operate with a delay time corresponding to a difference between the detected driving information and a reference value.

26 Claims, 7 Drawing Sheets

IMAGE FORMING APPARATUS AND CONTROL METHOD THEREOF

CROSS-REFERENCE TO RELATED APPLICATIONS

This application claims priority under 35 U.S.C. §119(a) from Korean Patent Application No. 10-2007-0049235, filed on May 21, 2007 in the Korean Intellectual Property Office, the disclosure of which is incorporated herein in its entirety by reference.

BACKGROUND OF THE INVENTION

1. Field of the Invention

The present general inventive concept relates to an image forming apparatus and a control method thereof, and more particularly, to an image forming apparatus driven by a motor and a control method thereof.

2. Description of the Related Art

As illustrated in FIG. 1, a printer performs printing operation by feeding paper to be printed to a feeding unit 30 and discharging a black ink 11 and a color ink 12 to the paper according to a control if a printing command is received from a host. Here, the black ink 11 and the color ink 12 are accommodated in a carriage 20 and move along a carriage guide 55.

The printer includes a motor (not illustrated) to drive a moving roller 40 moving the paper and a motor (not illustrated) moving the carriage 20, and the printer performs the printing operation in a printing period P using the two motors.

Referring to a time chart illustrated in FIG. 2 according to a printing operation of a related art image forming apparatus, a speed (V) of the carriage motor moving the carriage 20 gradually increases, is maintained constant during the printing period P, and is slowed down gradually after the printing period P. Meanwhile, the line feeding motor moving the paper starts operating at an end time of the printing period P of the carriage motor and finishes operation right before a subsequent printing period P.

However, if a motor is operated continuously without pause after a printing operation in order to have a fast printing speed, a temperature of the motor rises and motor resistance also increases, thereby deteriorating properties of the motor.

If the temperature of the motor rises beyond a proper level, the motor may malfunction.

SUMMARY OF THE INVENTION

The present general inventive concept provides an image forming apparatus which prevents overload due to continued operations of a motor, and prevents deterioration of a control property due to a rise in temperature resistance, and a control method thereof.

Additional aspects and/or utilities of the present general inventive concept will be set forth in part in the description which follows and, in part, will be obvious from the description, or may be learned by practice of the present general inventive concept.

The foregoing and/or other aspects and utilities of the present general inventive concept can be achieved by providing an image forming apparatus, including an image forming unit, a driver having a driving unit as a driving source of the image forming unit, a detector which detects driving information of the driving unit, and a controller which controls the driver to operate with a delay as much as a delay time corresponding to a difference between the detected driving information and a reference value.

The controller may estimate a temperature value corresponding to the difference, and may control the driver to operate with a delay as much as the delay time corresponding to the estimated temperature value.

The controller may control the driver to operate with a zero delay time if the estimated temperature value is lower than a minimum temperature.

The driving unit may include a carriage motor to drive a carriage which carries an ink discharger, and a moving roller motor to drive a moving roller which moves a printing medium, and the controller may control one of the carriage motor and the moving roller motor to operate with a delay as much as the delay time corresponding to the difference.

The controller may control the driver to operate with the delay corresponding to the difference at one of a time before driving start time of the driver, after driving finish time of the driver, and while driving of the driver.

The controller may calculate an average delay time per reference unit of the printing medium, and controls the driver to operate with a delay as much as the average delay time for the printing medium to be printed after the reference unit.

The foregoing and/or other aspects and utilities of the present general inventive concept can also be achieved by providing a method of controlling an image forming apparatus, the method including detecting driving information of a driving unit which is a driving source of an image forming unit and provided in a driver, calculating a difference between the detected driving information and a stored reference value, and driving the driver to operate with a delay as much as a delay time corresponding to the calculated difference.

The calculating of the difference may include estimating a temperature value corresponding to the calculated difference.

The driving of the driver to operate with the delay may include driving the driver with a zero delay time when the estimated temperature value is lower than a minimum critical temperature.

The driving unit may include a carriage motor to drive a carriage which carries an ink discharger, and a moving roller motor to drive a moving roller which moves a printing medium, and the driving of the driver to operate with the delay may include driving one of the carriage motor and the moving roller motor to operate with a delay as much as a delay time corresponding to the calculated difference.

The driving of the driver to operate with the delay time may include driving the driver to operate with the delay time corresponding to the calculated difference at one of a time before driving start time of the driver, after driving finish time of the driver, and while driving of the driver.

The method may further include calculating an average delay time per reference unit of the printing medium, and driving the driver to operate with a delay as much as the average delay time for the printing medium to be printed after the reference unit.

The foregoing and/or other aspects and utilities of the present general inventive concept can also be achieved by providing an image forming apparatus, including an image forming unit to form an image on a printing medium, a driver to drive a movement of the image forming unit, the driver having at least one motor, and a controller to control an operation of the at least one motor and to operate the at least one motor with a delay time according to a temperature of the at least one motor.

The controller may operate the at least one motor with a zero delay time if the temperature of the at least one motor is less than a predetermined reference temperature.

The image forming apparatus may further include a detector to detect driving information of the at least one motor, wherein the controller calculates the temperature according to a difference between the detected driving information and a reference value.

The delay time with which the at least one motor is operated may increase with an increase in the temperature of the at least one motor above the predetermined reference temperature.

A printing time of the printing medium may increase according to an increase in the temperature above a predetermined reference temperature of the at least one motor.

Operation of the at least one motor with the delay time may increase a printing time of the printing medium according to an increase in the temperature above a predetermined reference temperature of the at least one motor.

The delay time may include an average delay time, the controller may calculate the average delay time according to a predetermined reference number of printing operations, and the controller may control operation of the at least one motor to operate with the average delay time for the predetermined reference number of printing operations.

The foregoing and/or other aspects and utilities of the present general inventive concept can also be achieved by providing a method of controlling an image forming apparatus, the method including calculating a temperature of at least one motor of a driving source of the image forming apparatus, determining a difference between the calculated temperature and a predetermined reference temperature, and operating the at least one motor with a delay time corresponding to the determined difference.

The delay time may equal zero when the calculated temperature is below the predetermined reference temperature.

A printing time of a printing medium may increase according to an increase of the calculated temperature above the predetermined reference temperature.

The delay time may include an average delay time based on a predetermined number of printing operations, and the operation of the least one motor may include operation of the at least one motor using the average delay time for the predetermined number of printing operations The foregoing and/or other aspects and utilities of the present general inventive concept can also be achieved by providing a computer readable recording medium including computer readable codes to perform a method to control an image forming apparatus including detecting driving information of a driving unit which is a driving source of an image forming unit and provided in a driver, calculating a difference between the detected driving information and a stored reference value, and driving the driver to operate with a delay time corresponding to the calculated difference.

The foregoing and/or other aspects and utilities of the present general inventive concept can also be achieved by providing a computer readable recording medium comprising computer readable codes to perform a method to control an image forming apparatus including calculating a temperature of at least one motor of a driving source of the image forming apparatus, determining a difference between the calculated temperature and a predetermined reference temperature, and operating the at least one motor with a delay time corresponding to the determined difference.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
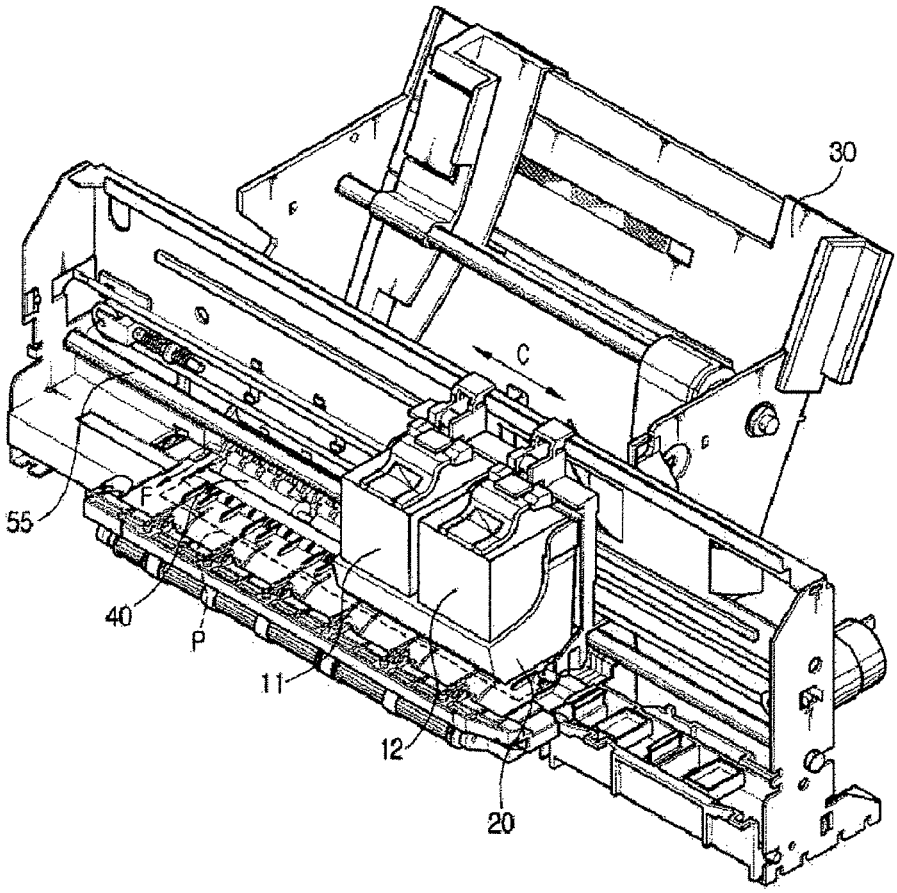
FIG. 1 (RELATED ART)
FIG. 1 illustrates a configuration of a related art image forming apparatus.
Figure 2:
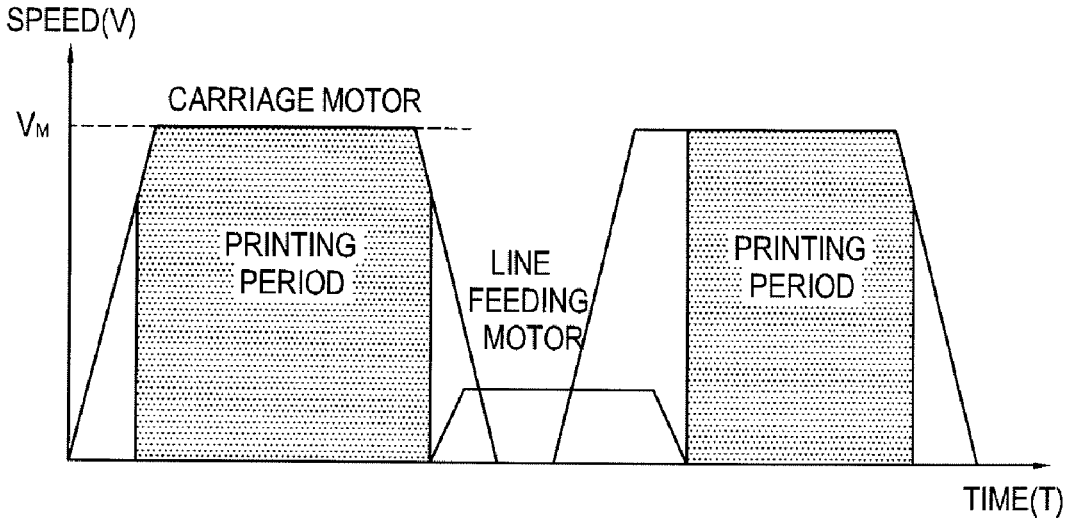
FIG. 2 (RELATED ART)
FIG. 2 illustrates operation of a motor of the related art image forming apparatus illustrated in FIG. 1.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 3:
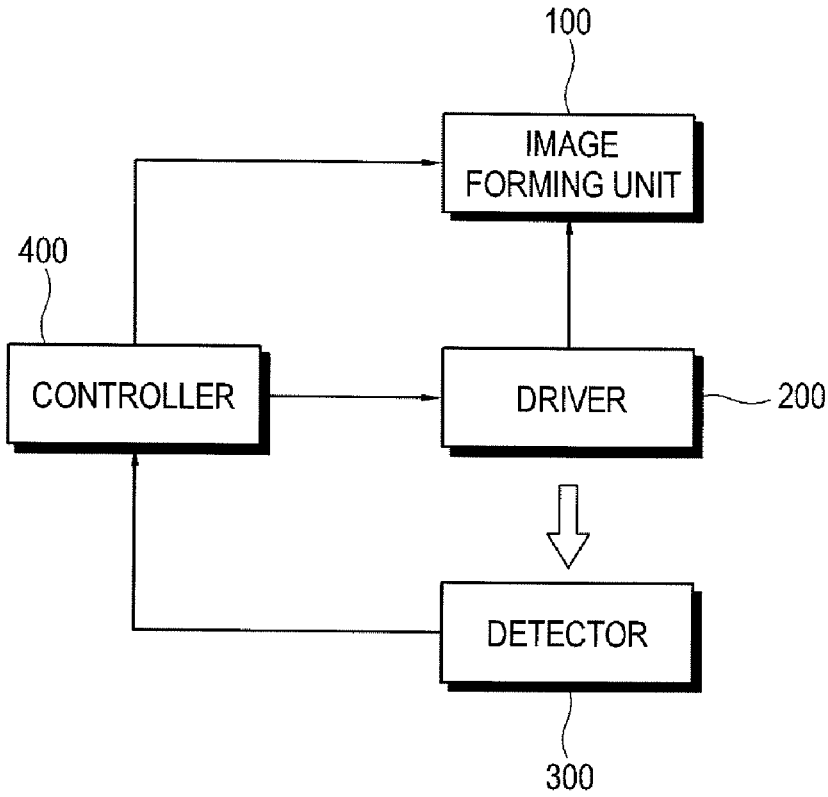
FIG. 3 is a control block diagram of an image forming apparatus according to an exemplary embodiment of the present general inventive concept.

As illustrated in FIG. 3, an image forming apparatus according to an exemplary embodiment of the present general inventive concept may include an image forming unit 100, a driver 200, a detector 300, and a controller 400.

The image forming unit 100 may include an ink discharger (not illustrated) which discharges an ink onto paper to form an image according to control of the controller 400 (to be described later), a carriage (not illustrated) which accommodates the ink discharger and moves in a main scanning direction according to the control of the controller 400 and a moving roller (not illustrated) which moves the paper.

The driver 200 may include a driving unit to drive the carriage and the moving roller of the image forming part 100 and may be provided as a direct current (DC) motor. According to an exemplary embodiment of the present general inventive concept, a carriage motor and a moving roller motor are driven by a proportional integral (PI) control command, i.e., a motor control command from the controller 400.

The detector 300 detects driving information of the driving unit. The detector 300 according can detect the driving information, such as rotation speed and physical rotation distance of a motor as the driving unit, by using an encoder, a light emitter, and a light receiver provided in the driver 200.

For example, if light is emitted from the light emitter of the encoder and reflected in a reflection surface, the light receiver receives the light and may calculate the rotation speed according to a number of generated pulses and pulse moving time. The encoder may include two channels and may detect the rotation speed and the physical rotation distance of the motor having direction information.

The controller 40 can transmit a control command to the driver 200, and can receive the current rotation information of the driver 200 from the detector 300 to calculate a difference from the control command based on the received rotation information. Then, the controller 400 calculates a delay time corresponding to the calculated difference.

For example, the delay time may be calculated as follows.

Figure 4:
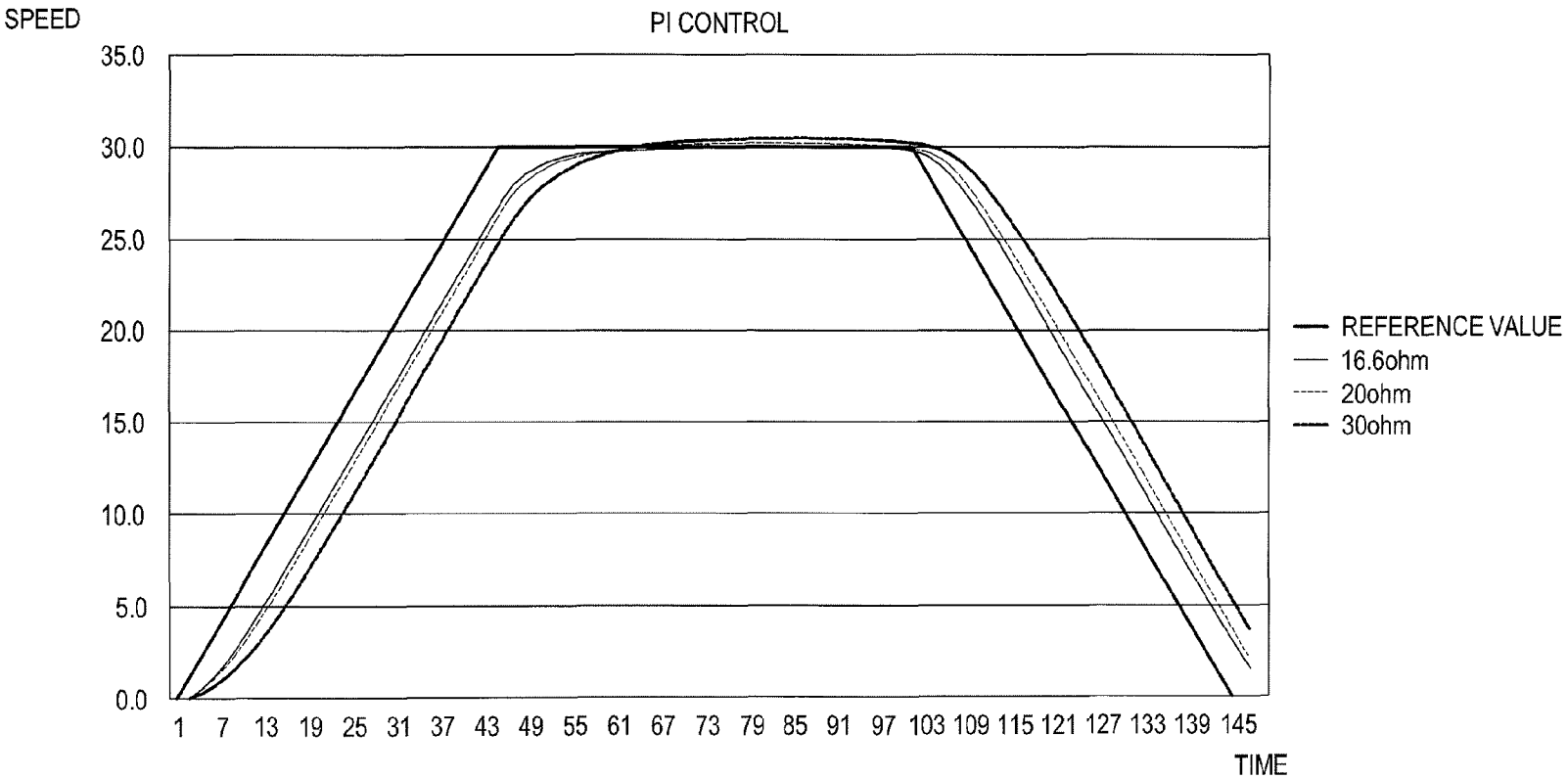
FIG. 4 illustrates operation of a motor of the image forming apparatus according to an exemplary embodiment of the present general inventive concept.

FIG. 4 illustrates a speed command of the PI control according to an exemplary embodiment of the present general inventive concept. As illustrated therein, as the motor resistance increases, the control performance by the PI control becomes lowered. The variation of the motor resistance refers to a resistance value which varies due to rising temperature of a motor that is continuously driven, and includes corresponding performance of the motor. The integration of the speed is a moving distance. The speed of the motor reaching a target point and entering into a stop mode increases along with growing resistance. Thus, the motor further operates from the target point according to inertia of the current speed even if the controller 400 transmits a stop command to the motor. That is, the amount of movement of the motor increases in a predetermined proportion to the resistance change in the motor.

Here, an error in the amount of the movement may be calculated by following Formula 1.

$$\text{delta_}T = T\text{current} - T\text{amb}$$

$$\text{delta_}R = Kt^{*}(\text{delta_}T)$$

$$\text{delta_ErrorDist} = Kd^{*}(\text{delta_}R) \qquad \text{<Formula 1>}$$

Here, delta_R refers to a changed amount of resistance and delta_T is a changed amount of temperature. delta_ErrorDist is an error of an amount of the movement.

An absolute sum of accumulated speed differences, which is a sum of the difference between the speed command and the current speed in FIG. 4, has similar features with Formula 2.

$$\text{ErrorSum} = \Sigma abs(\text{target speed} - \text{current speed})$$

$$\text{delta_}R = Kt^{*}(\text{delta_}T)$$

$$\text{delta_ErrorDist} = Kc^{*}\text{ErrorSum} \qquad \text{<Formula 2>}$$

Here, delta_R is the changed amount of the resistance and ErrorSum is an absolute sum of the accumulated speed differences. delta_ErrorDist is an error of the amount of the movement.

According to Formulas 1 and 2, the error of the amount of the movement according to the motor resistance is proportional to a delay time at which the motor returns to a start point, which may be represented by Formula 3.

$$\text{SwathDelayTime} = K\text{delay}^{*}\text{delta_ErrorDist} \qquad \text{<Formula 3>}$$

Figure 5:
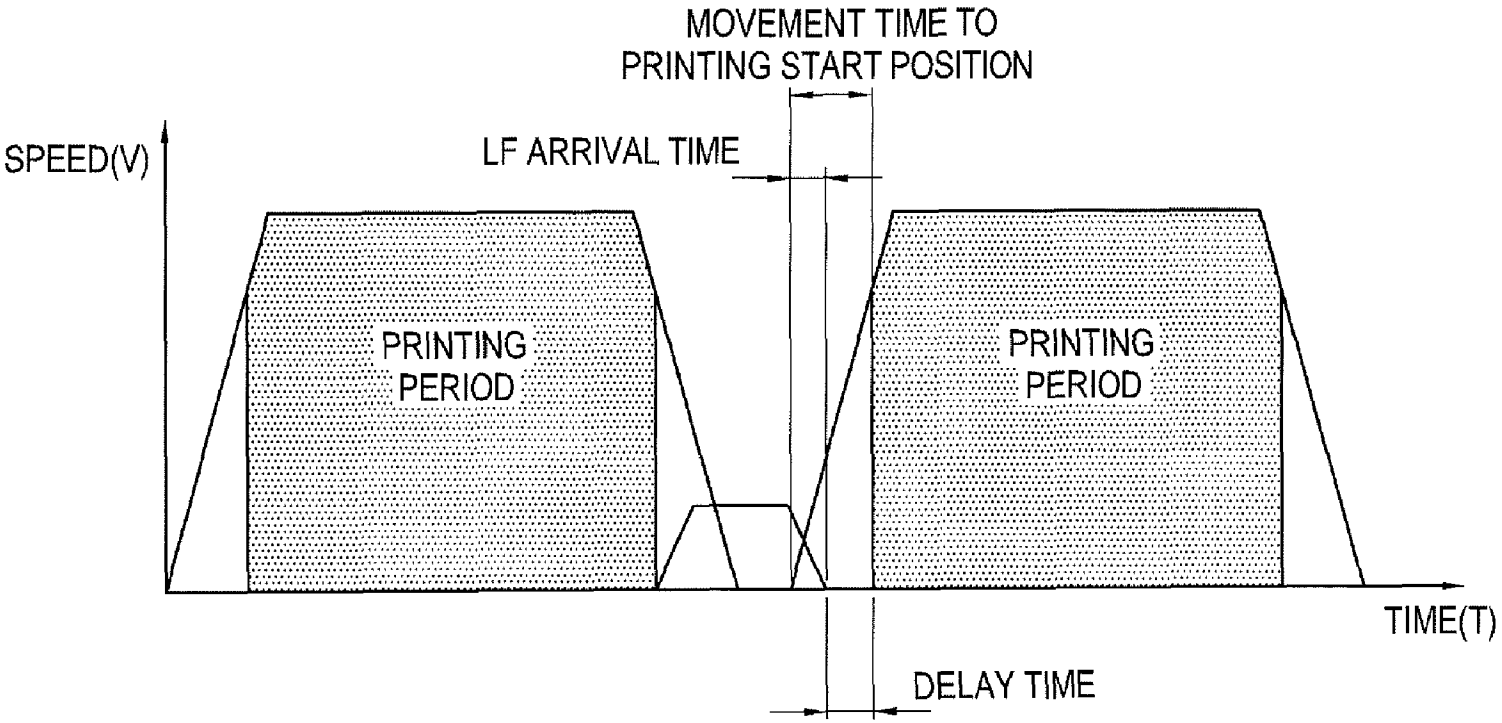
FIG. 5 illustrates variation in a complying speed depending on various motor resistances according to an exemplary embodiment of the present general inventive concept.

As illustrated in FIG. 5, the controller 400 can calculate the delay time to lower the temperature of the motor with Formula 3, and controls the driver 200 to delay driving the motor as much as the calculated delay time. The motor resistance rises due to the temperature of the motor.

According to an exemplary embodiment of the present general inventive concept, the time to operate the carriage motor may be represented as follows:

Movement time to a printing position=arrival time of moving roller motor+delay time Meanwhile, the delay time may be applicable from a time before a driving start point of the moving roller or from a time after a driving finish point of the moving roller, or may be added to a driving start point of the carriage motor, or may be implemented by lowering the driving speed of the moving roller motor or the carriage motor as much as the delay time.

Figure 6:
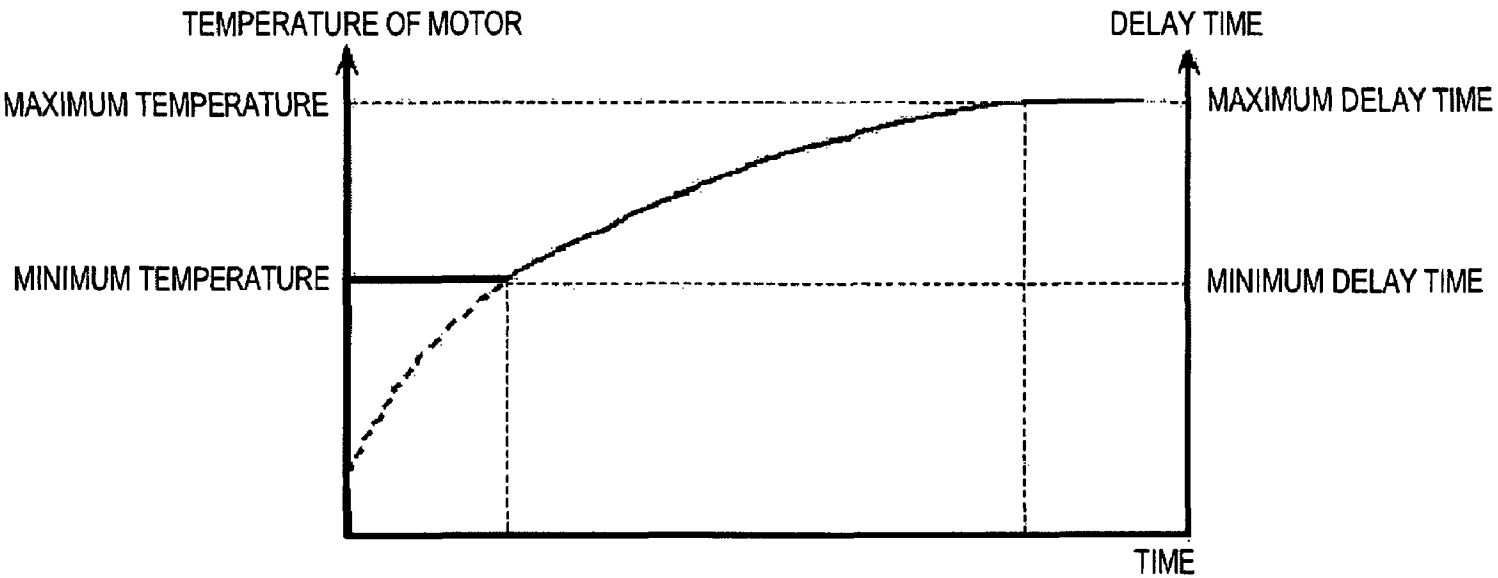
FIG. 6 illustrates a change in temperature properties of a motor according to an exemplary embodiment of the present general inventive concept.

The controller 400 can calculate the delay time of the driver 200 according to the temperature of the motor. FIG. 6 illustrates variation of the temperature properties in the motor according to an exemplary embodiment of the present general inventive concept.

As illustrated therein, the delay time is not applied from a current ambient temperature (ambTemp) to a minimum temperature (MinTemp) of the motor, where the temperature does not affect the control property of the motor. Thus, increased printing time due to the temperature variation is not illustrated therein.

The delay time starts increasing from the minimum temperature (MinTemp) corresponding to the increase in temperature. Thus, the printing time increases along with the rising temperature of the motor. Here, a max swath delay time refers to a delay time until the motor reaches a maximum temperature (MaxTemp) from which the temperature of the motor does not rise with the continued printing operation.

For example, assuming that 25 sheets of paper is the number of printing sheets of paper in which the temperature of the motor reaches the minimum temperature (MinTemp), which does not affect the control performance of the motor even in a continued printing operation, the controller 400 may control the driver 200 according to Program 1.

<Program 1>

```
if(page>25)
SwathDelayTime = Kdelay * delta_ErrorDist;
else
SwathDelayTime = 0;
```

The controller 400 may control the driver 200 by applying the max swath delay time according to Program 2 if the temperature of the motor is higher than the maximum temperature MaxTemp.

<Program 2>

```
if(SwathDelayTime>MaxTemp)
SwathDelayTime = MaxDelayTime;
```

To estimate the temperature of the motor, the controller 400 may calculate an average delay time per page to prevent a drastic change.

That is, the controller 400 may calculate the average delay time according to the unit temperature of the driver 200 which prints a basic page and apply the same delay time to the same pages. The controller 400 may estimate the temperature of the motor when one page has been printed and then drive the driver 200 by applying the corresponding delay time to a subsequent page.

Figure 7:
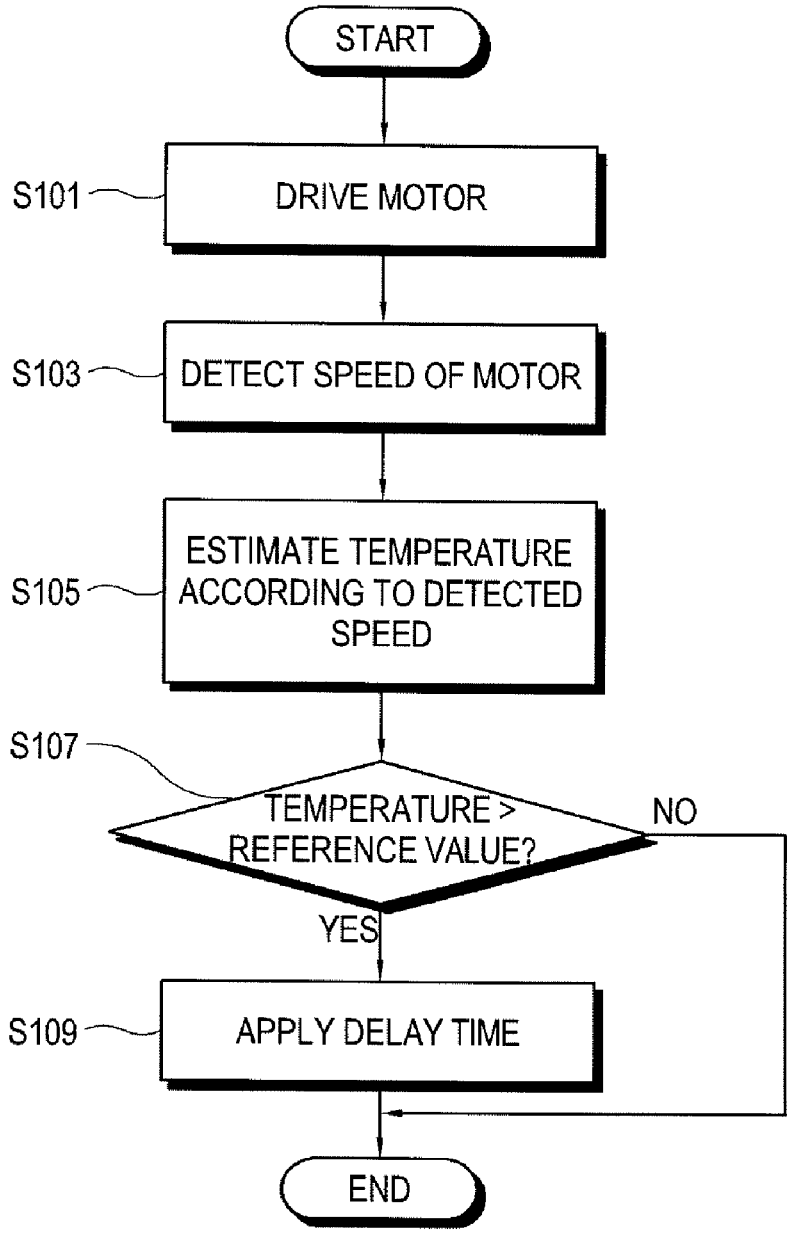
FIG. 7 is a control flowchart of an image forming apparatus according to an exemplary embodiment of the present general inventive concept.

FIG. 7 illustrates operation of the image forming apparatus according to an exemplary embodiment of the present general inventive concept.

As illustrated therein, the controller 400 transmits the control command to the driver 200 to drive the motor in operation S101. The detector 300 then detects the rotation speed of the motor of the driver 200 in operation S103. Then, the controller 400 estimates the temperature of the motor from the rotation speed of the motor detected by the detector 300 in operation S105.

The controller 400 then determines whether the estimated temperature of the motor is higher than the reference value in operation S107. If it is determined that the temperature of the motor is higher than the reference value, the controller 400 calculates the error of the amount of the movement by using the motor resistance depending on the temperature of the motor, and drives the driver 200 by applying the delay time calculated according to the error of the amount of the movement in operation S109.

If the temperature of the motor is lower than the reference value, the controller 400 may drive the driver 200 without applying the delay time thereto.

As described above, the present general inventive concept provides an image forming apparatus which prevents overload due to a continued operation of a motor, and prevents deterioration of a control property due to rising temperature resistance, and a control method thereof.

A delay time is not applied if a temperature of the motor rises within a range not affecting the control property of the motor, thereby securing the optimal printing speed as long as the number of printing media does not affect the motor specification.

Various embodiments of the present general inventive concept can be embodied as computer readable codes on a computer-readable medium. The computer-readable medium includes a computer-readable recording medium and a computer-readable transmission medium. The computer readable recording medium may include any data storage device suitable to store data that can be thereafter read by a computer system. Examples of the computer readable recording medium include, but are not limited to, a read-only memory (ROM), a random-access memory (RAM), CD-ROMs, magnetic tapes, floppy disks, optical data storage devices, and carrier waves (such as data transmission through the Internet). The computer readable transmission medium can be distributed over network coupled computer systems, through wireless or wired communications over the internet, so that the computer readable code is stored and executed in a distributed fashion. Various embodiments of the present general inventive concept may also be embodied in hardware or in a combination of hardware and software.

Although a few embodiments of the present general inventive concept have been shown and described, it will be appreciated by those skilled in the art that changes may be made in these embodiments without departing from the principles and spirit of the general inventive concept, the scope of which is defined in the

What is claimed is:

1. An image forming apparatus, comprising:

an image forming unit;

a driver having a driving unit as a driving source of the image forming unit;

a detector which detects driving information of the driving unit; and a controller which controls the driver to operate with a delay as much as a delay time corresponding to a difference between the detected driving information and a reference value.

2. The image forming apparatus according to claim 1, wherein the controller estimates a temperature value corresponding to the difference, and controls the driver to operate with a delay as much as the delay time corresponding to the estimated temperature value.

3. The image forming apparatus according to claim 2, wherein the controller controls the driver to operate with a zero delay time if the estimated temperature value is lower than a minimum temperature.

4. The image forming apparatus according to claim 1, wherein the driving unit comprises a carriage motor to drive a carriage which carries an ink discharger, and a moving roller motor to drive a moving roller which moves a printing medium, and the controller controls one of the carriage motor and the moving roller motor to operate with a delay as much as the delay time corresponding to the difference.

5. The image forming apparatus according to claim 1, wherein the controller controls the driver to operate with the delay corresponding to the difference at one of a time before driving start time of the driver, after driving finish time of the driver, and while driving of the driver.

6. The image forming apparatus according to claim 5, wherein the controller calculates an average delay time per reference unit of the printing medium, and controls the driver to operate with a delay as much as the average delay time for the printing medium to be printed after the reference unit.

7. A method of controlling an image forming apparatus, the method comprising:

detecting driving information of a driving unit which is a driving source of an image forming unit and provided in a driver;

calculating a difference between the detected driving information and a stored reference value; and driving the driver to operate with a delay as much as a delay time corresponding to the calculated difference.

8. The method according to claim 7, wherein the calculating the difference comprises estimating a temperature value corresponding to the calculated difference.

9. The method according to claim 8, wherein the driving of the driver to operate with the delay comprises driving the driver with a zero delay time when the estimated temperature value is lower than a minimum temperature.

10. The method according to claim 7, wherein the driving unit comprises a carriage motor to drive a carriage which carries an ink discharger, and a moving roller motor to drive a moving roller which moves a printing medium; and the driving the driver to operate with the delay comprises driving one of the carriage motor and the moving roller motor to operate with a delay as much as a delay time corresponding to the calculated difference.

11. The method according to claim 7, wherein the driving the driver to operate with the delay comprises driving the driver to operate with a delay as much as the delay time corresponding to the calculated difference at one of a time before driving start time of the driver, after driving finish time of the driver, and while driving of the driver.

12. The method according to claim 11, further comprising:

calculating an average delay time per reference unit of the printing medium, and driving the driver to operate with a delay as much as the average delay time for the printing medium to be printed after the reference unit.

13. An image forming apparatus, comprising:

an image forming unit to form an image on a printing medium;

a driver to drive a movement of the image forming unit, the driver having at least one motor; and a controller to control an operation of the at least one motor, and to operate the at least one motor with a delay time according to a temperature of the at least one motor.

14. The image forming apparatus according to claim 13, wherein the controller operates the at least one motor with a zero delay time if the temperature of the at least one motor is less than a predetermined reference temperature.

15. The image forming apparatus according to claim 14, wherein the delay time with which the at least one motor is operated increases with an increase in the temperature of the at least one motor above the predetermined reference temperature.

16. The image forming apparatus according to claim 13, further comprising:

a detector to detect driving information of the at least one motor, wherein the controller calculates the temperature according to a difference between the detected driving information and a reference value.

17. The image forming apparatus of claim 13, wherein a printing time of the printing medium increases according to an increase in the temperature above a predetermined reference temperature of the at least one motor.

18. The image forming apparatus of claim 13, wherein operation of the at least one motor with the delay time increases a printing time of the printing medium according to an increase in the temperature above a predetermined reference temperature of the at least one motor.

19. The image forming apparatus according to claim 13, wherein the delay time comprises an average delay time, the controller calculates the average delay time according to a predetermined reference number of printing operations, and the controller controls operation of the at least one motor to operate with the average delay time for the predetermined reference number of printing operations.

20. A method of controlling an image forming apparatus, the method comprising:

calculating a temperature of at least one motor of a driving source of the image forming apparatus;

determining a difference between the calculated temperature and a predetermined reference temperature; and operating the at least one motor with a delay time corresponding to the determined difference.

21. The method according to claim 20, wherein the delay time equals zero when the calculated temperature is below the predetermined reference temperature.

22. The method according to claim 21, wherein a printing time of a printing medium increases according to an increase of the calculated temperature above the predetermined reference temperature.

23. The method of claim 20, wherein the delay time comprises an average delay time based on a predetermined number of printing operations, and the operation of the least one motor comprises operation of the at least one motor using the average delay time for the predetermined number of printing operations.

24. A computer readable recording medium comprising computer readable codes to perform a method to control an image forming apparatus, comprising:

detecting driving information of a driving unit which is a driving source of an image forming unit and provided in a driver;

calculating a difference between the detected driving information and a stored reference value; and driving the driver to operate with a delay time corresponding to the calculated difference.

25. A computer readable recording medium comprising computer readable codes to perform a method to control an image forming apparatus, comprising:

calculating a temperature of at least one motor of a driving source of the image forming apparatus;

determining a difference between the calculated temperature and a predetermined reference temperature; and operating the at least one motor with a delay time corresponding to the determined difference.

26. An image forming apparatus, comprising:

an image forming unit to form an image;

a drive unit to drive the image forming unit;

a controller to control the drive unit to drive with a delay according to a difference in resistance of the drive unit when driven and a reference value.

* * * * *